United States Patent [19]

Gilliland et al.

[11] 4,047,763

[45] Sept. 13, 1977

[54] MINING MACHINE WITH CUTTER DRUM HAVING INTERNAL DRIVE MOTORS

[75] Inventors: James L. Gilliland, Emlenton; Frank B. Kendrick, Franklin, both of Pa.

[73] Assignee: Joy Manufacturing Comapny, Pittsburgh, Pa.

[21] Appl. No.: 680,652

[22] Filed: Apr. 27, 1976

[51] Int. Cl.[2] ..... E21C 27/24

[52] U.S. Cl. ..... 299/76; 299/89

[58] Field of Search ..... 299/75, 76, 78, 89

[56] References Cited

U.S. PATENT DOCUMENTS

| | | | |
|---|---|---|---|
| 3,157,438 | 11/1964 | Lundquist | 299/89 X |
| 3,288,536 | 11/1966 | Galis et al. | 299/76 X |
| 3,290,096 | 12/1966 | Stalker | 299/78 |
| 3,305,273 | 2/1967 | Kilbourne | 299/78 |
| 3,362,753 | 1/1968 | Sibley | 299/76 X |

*Primary Examiner*—Ernest R. Purser

*Attorney, Agent, or Firm*—J. Stewart Brams

[57] ABSTRACT

A continuous mining machine having a rotary cutter drum provided with internal drive motors. The drive motors extend on opposite sides of the support boom for the rotary cutter drum and each motor is within the axial extent of the cutter drum on each side of the support boom.

11 Claims, 3 Drawing Figures

MINING MACHINE WITH CUTTER DRUM HAVING INTERNAL DRIVE MOTORS

In the mining arts it is well known to provide a continuous mining apparatus having a generally elongated rotary drum cutter head rotatably and adjustably carried by the mining machine for rotation about an axis extending generally transversely of the machine base to gouge or tear mineral from the face of a mineral seam. Such mining apparatus has commonly been employed in underground coal mining for example. Although known drum cutter heads for continuous miners have generally served the purposes intended they have nonetheless often been subject to serious deficiencies. For example, many prior cutter heads have been driven by motors and driving gear trains or chains carried externally of the cutter head by the cutter head support boom. Such external drives have been quite complicated and therefore difficult and expensive to manufacture. Additionally, many externally driven cutter heads have not been adapted to cut clearance for their supports and driving means and have thus required separate auxiliary cutter means to cut such clearance. Other prior cutter heads have included internally carried drive means in lieu of externally carried drives to alleviate some of the above-mentioned difficulties; however, these too have been unable to cut clearance for their supports. For example, at the support points where the boom rotatably supports such cutter heads at or intermediate the ends thereof, the head has not been adapted to present a cutter means to the mineral face and thus auxiliary cutters have been required to cut clearance for the forward portion of the support boom. In the prior art these and similar problems have often been generally characterized as the problem of placing all cutter heads drive and support components within the cutting "shadow" of the cutter head. In other words, the cutter head ideally should cut full clearance not only for the cutter head itself, but in addition for all non-cutting portions of the machine, including drive motors and gearing, power lines and fluid lines, cutter head supports and of course the machine base. A cutter head which fails to provide such clearance requires auxiliary cutter means as hereinabove mentioned, or in lieu thereof greatly complicates the mining operation by requiring multiple passes of the cutter head over the mineral seam face to cut the required clearance. The present invention alleviates these and other deficiencies of prior cutter heads by providing an internally driven rotary cutter head able to cut full clearance particularly for the forward portion of the cutter head support boom and more generally for all machine components thus obviating the need for auxiliary cutter means. In other words, all of the machine components requiring clearance to pass through mined out areas are located within the cutting shadow of the cutter head of this invention, which includes no auxiliary cutters apart from the main cutter head. The cutter head of this invention additionally provides a novel reduction gearing arrangement and means including a hollow drive shaft of a motor with a driven shaft extending therethrough for driving loads spaced axially in opposite directions from the motor and for transferring drive torque from a relatively lightly loaded or unloaded portion of the cutter head to a relatively more heavily loaded portion.

These and other objects and advantages of the instant invention are more fully specified in the following description with reference to the accompanying figures in which.

Figure 1:
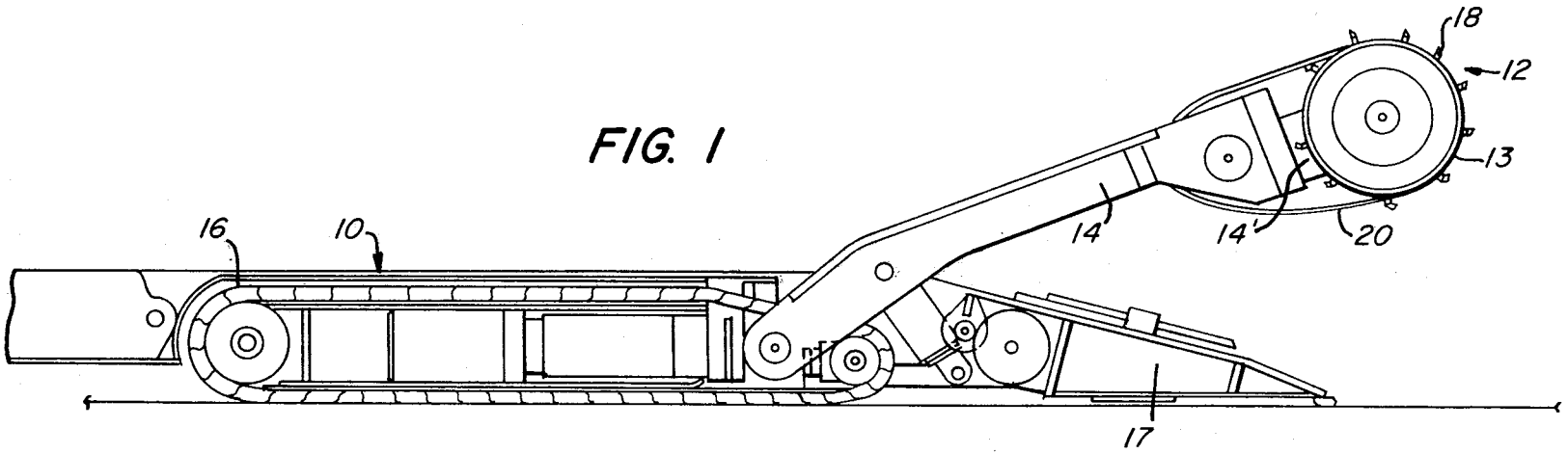
FIG. 1 is a side elevation of a mining machine including cutter head means of this invention.

There is generally indicated at 10 in FIG. 1 a mining machine including a rotary drum type cutter head 12 constructed according to the principles of the instant invention and including cutter means shown as a plurality of circumferentially and axially spaced cutter bits 18 carried by axially spaced and aligned rotatable drum portions 13 of head 12 (FIG. 2), and cutter chain means 20 disposed axially intermediate the drums 13 for orbital motion therewith. Head 12 is supported adjacent the forward end of an elongated boom 14 and extends generally transversely thereof and coaxially with respect to the axis of rotation X—X of drums 13.

Boom 14 is in turn adjustably carried adjacent the forward end of a suitable mobile base 16 such as a crawler frame for vertical swinging with respect to base 16 above a gathering head portion 17 thereof whereby the machine 10 is adapted for continuous mining of mineral from a mineral seam by continuous powered rotation and orbiting of drums 13 and chain 20, respectively, while engaging the exposed face of such a seam to tear or gouge mineral therefrom. Inasmuch as the apparatus described hereinabove is well known in the art further detailed description thereof is omitted herefrom. Suffice it to note in this regard that cutter head 12 is constructed and carried by boom 14 in a manner to be described hereinbelow so as to be rendered able to cut clearance for a forward end portion 14' of boom 14 without recourse to auxiliary cutters, and more generally to cut clearance for all non-cutting portions of the machine 10.

Figure 3:
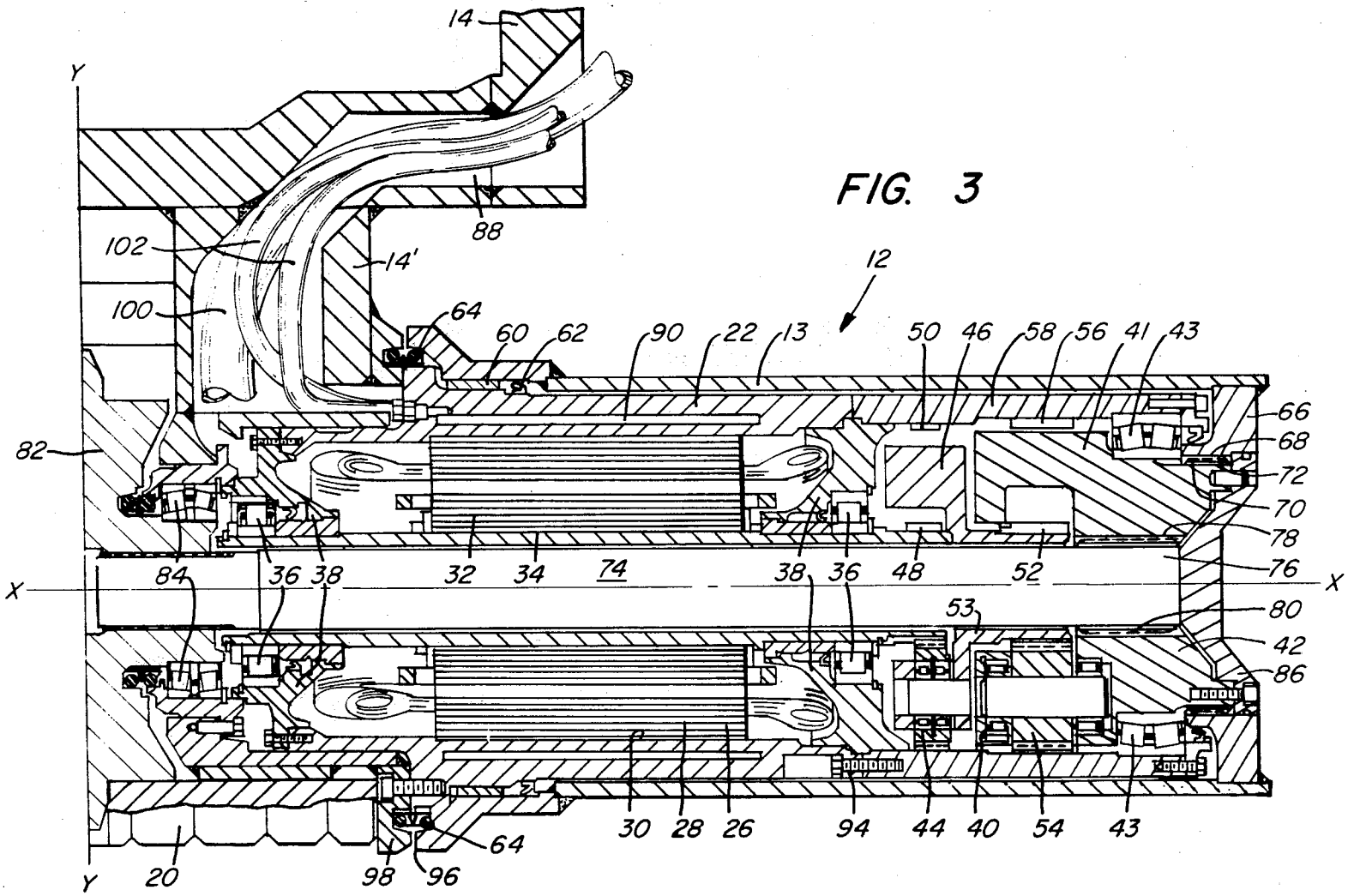
FIG. 3 is an axial section of one half portion of the cutter head taken on line 3—3 of FIG. 2.

In FIG. 3 only one-half longitudinal portion of the cutter head 12 is illustrated and the non-illustrated half portion is the mirror image of the illustrated portion about central plane Y—Y. Additionally, head 12 is generally symmetrical about its central longitudinal axis X—X. Head 12 includes a rigid, generally annular elongated support portion or frame 22 rigidly affixed adjacent an axially central portion thereof to the forward end portion 14' of boom 14 and extending in axially opposite directions therefrom to form with the boom 14 a unitary mining head support structure. Each axial half of the frame 22 carries coaxially therewithin a drive means comprised of a generally annular motor 26 having an elongated tubular drive shaft 34 for driving the rotatable portions of head 12 through a planetary gear reduction train 40 and drive elements connected thereto as described hereinbelow. Motor 26 includes a stator portion 28 non-rotatably affixed adjacent an inner peripheral portion 30 of frame 22, and a rotor portion 32 non-rotatably affixed to an axially intermediate portion of the shaft 34 which is coaxially rotatably supported within frame 22 by roller bearings 36 spaced axially in opposite directions from motor 26 and carried by radially inwardly extending portions 38 of frame 22.

Planetary gear train 40 rotatably drivingly connects shaft 34 to a generally annular drive member 42 rotatably supported coaxially adjacent an axially outer end portion of head 12 by roller bearings 43. Gearing 40 includes a first plurality of planet gears 44 rotatably carried at circumferentially spaced locations in a generally annular, coaxially disposed cage 46 and radially intermediate a rotatable sun gear 48 formed on the outer periphery of shaft 34 adjacent the axially outer end thereof and a stationary annulus gear 50 formed on the inner periphery of an axially outward end portion 58 of frame 22 radially outwardly of sun gear 48. A second plurality of planet gears 54 is rotatably carried at circumferentially spaced locations in a cage portion 41 of drive member 42 radially intermediate a second sun gear 52 formed upon the outer periphery of an axially outwardly extending portion 53 of cage 46, and a second stationary annular gear 56 formed on the inner periphery of frame portion 58 radially outwardly of sun gear 52. Gearing arrangements such as the planetary sets 40 are well known in the art and thus it will be apparent without further explanation that motor 26 is adapted to drive the member 42 in coaxial rotation through shaft 34 and the double planetary gear reduction sets 40.

The axially outer end portion 58 of frame 22 upon which annular gears 50 and 56 are formed is a unitary annular member preferably removably carried by the adjacent axially inward portion of frame 22 as by threaded fasteners 94 whereby annulus gears 50 and 56 may be removed from the head 12 for servicing, overhaul or replacement as desired.

The elongated annular drum 13 (shown without bits 18 in FIG. 3) coaxially encompasses the axially outwardly extending portion of frame 22 and is supported for coaxial rotation with respect thereto by means including a suitable annular bearing member 60 encompassing frame 22 and extending radially intermediate the inner axial end of drum 13 and frame 22. Suitable annular seals 62 and 64 are provided to maintain lubricant on bearing 60 for lubricating relatively movable surfaces of drum 13, bearing 60 and frame 22. Seal 64 additionally seals the small annular openings 96 between the axially inner end of drum 13 and an adjacent radially outwardly extending portion 98 of frame 22. A generally annular end member 66 is rigidly affixed adjacent the axially outermost end of drum 13 axially outwardly from frame 22 and extends generally radially inward such that a radially inner peripheral portion 68 thereof is supported by and drivingly engaged with a respective outer peripheral portion 70 of drive member 42 as by cooperating splines such that drum 13 is connected through shaft 34, gear train 40 and drive member 42 for rotation by motor 26.

A driven shaft 74 extends coaxially through shaft 34 and includes an axially outward end portion 76 extending within an inner peripheral portion 78 of member 42 and drivingly engaged therewith as by cooperating splines 80 for rotation by motor 26 by the same connections and with the same direction and rotational velocity described hereinabove for drum 13. The opposite axial end of shaft 74 extends within the central portion of frame 22 to coaxially drivingly engage a sprocket 82 rotatably carried by roller bearings 84 coaxially within the central portion of frame 22. Sprocket 82 in turn drivingly engages chain 20 which is disposed to extend axially intermediate the axially opposite frame portions 98 for orbital movement about the central portion of frame 22 and boom portion 14' by the sprocket 82 and any suitable cooperating support means such as rollers (not shown) carried by boom 14. Shaft 74 is accessible by removing an axially outer end plate 86 which is suitably removably secured to the axially outer end of member 42.

The boom 14 includes therein elongated passageways or openings 88 to provide for access by energizing means, fluid conduits and the like to the head 12, for example an insulated electrical conductor means 100 to provide power to motor 26 or fluid inlet and return conduits 102 to provide cooling fluid for circulation in cooling channels or passageways such as at 90 in frame 22 may be provided.

Figure 2:
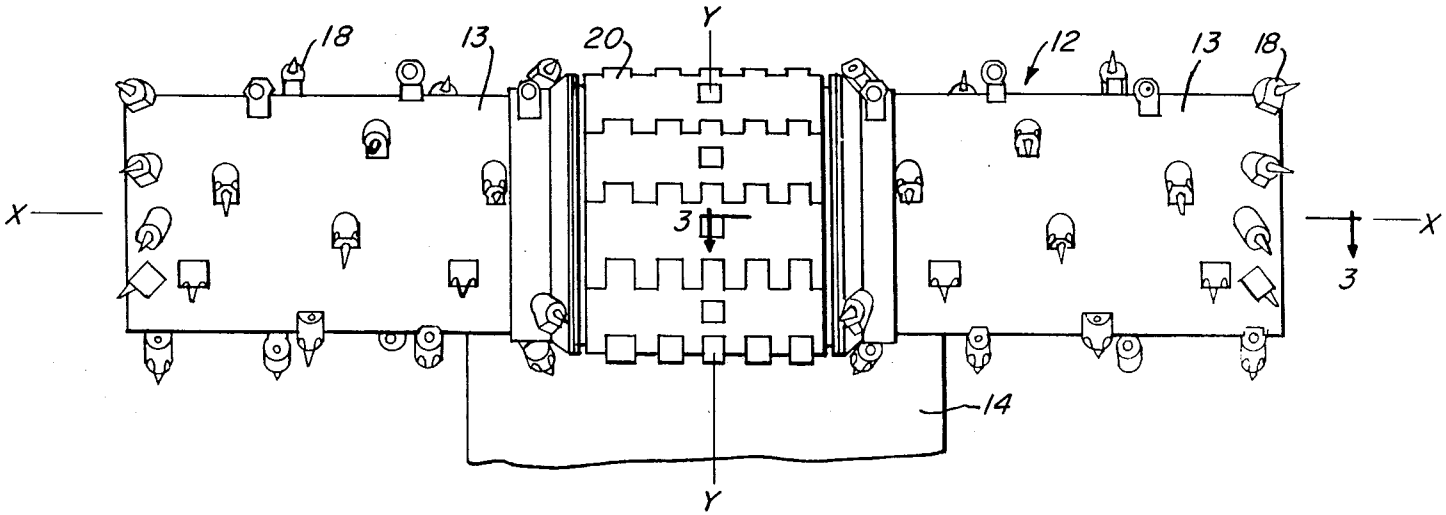
FIG. 2 is a fragmentary front elevation of the mining machine of FIG. 1 showing the cutter head of this invention.

The forward end portion 14' of the boom 14 which joins the central portion of frame 22 preferably is narrower than the major portion of boom 14, whereby the axially inward extent of drum 13 overlaps the laterally outward extent of the major portion of boom 14 and cuts clearance therefore during mining. As hereinabove noted the chain 20 is substantially coextensive laterally with the central portion of frame 22 intermediate frame portions 98 and the forward boom portion 14' whereby chain 20 cuts clearance for the boom portion 14' and the central portion of frame 22. Accordingly, the drum 13 and chain 20 of head 12 as described are able to cut all required clearance for the boom 14 and frame 22. The frame portion 98 axially intermediate chain 20 and drum 13 is the only non-cutting portion of miner head 12 presented to the mineral face during mining operations. However, the frame portion 98 has no significant axial extent and therefore presents no problem with regard to the clearance required for the head as mining progresses. If desired, the cutter bits 18 positioned adjacent the axially inner end of drum 13 may be angled axially inward as shown in FIG. 2 at 18' to partially overlap and cut clearance for the frame portion 98.

An additional feature of the invention as described in a torque transfer capability provided by driven shaft 74 in each axial half portion of the head 12 being drivingly engaged within axially opposed end portions of the centrally disposed sprocket 82 whereby in the event of a load imbalance between the respective mining head axial half portions, the half portion with lighter loading will transfer a portion of the torque provided by motor 26 therein to the more heavily loaded head half portion through the respective driving connections of shafts 74 within sprockets 82. In an alternative arrangement of the instant invention the sprocket 82 may be replaced by a pair of coaxially spaced sprockets with each of the two driven shafts 74 drivingly engaging one of such pairs of sprockets to provide two independent drives for chain 20. In this case the torque transfer feature described hereinabove will be provided by torque transmission between the pair of sprockets through a separate rotary driving connection therebetween or through the chain 20 itself.

By virtue of the invention hereinabove described there is provided an improved mining head structure having internally carried, energizable drive means with an improved gear reduction train and novel rotary driving connections of the drive means to a mining head drum cutter portion and a cutter chain portion. The mining head of this invention provides the capability to cut clearance for the mining head, the boom and all external connections to the head for power, cooling fluid and the like solely by means of the drum and chain cutters as described and without recourse to auxiliary cutters.

Notwithstanding the description herein of a particular preferred embodiment, the invention may be practiced in numerous alternative embodiments and with various modifications without departing from the broad spirit and scope thereof. For example: motors 26 may be a fluid motor means; planetary gear sets 40 may take various alternative forms depending on the reduction desired and other applicable considerations with a typical reduction being a reduction from a motor speed of 1750 RPM to a drum speed of 57 RPM; the head 12 may be an axially extensible head; and the like.

These and other embodiments having been envisioned and anticipated by the inventors, it is respectfully requested that the invention be construed broadly and limited only by the scope of the claims appended hereto.

What is claimed is:

1. A mining machine comprising: a mobile support; a boom carried by said support and having an elongated extent with one end of said elongated extent forming the central portion of an elongated forward end of said boom extending transversely of said elongated extent along an axis; said forward end including elongated support portions extending outwardly from longitudinally spaced portions of said central portion coaxially along said axis; rotary means supported by said central portion for coaxial rotation about said axis; cutting means driven through an orbital path by said rotary means to cut clearance for at least said central portion; an elongated drum cutter means supported by said support portions, respectively, for coaxial rotation about said axis to cut clearance for the remainder of said forward end; elongated energizable drive means supported entirely within said forward end and extending coaxially along said axis; said drive means having substantially its entire axial extent extending outwardly of said central portion; elongated rotatable shaft means extending coaxially along said axis through the axial extent of said drive means and having a rotary driving connection to said rotary means; and said drive means having rotatable driving connections adjacent the axially outer end thereof to said cutter drum means and said shaft means for driving said cutter drum means and said cutting means, respectively.

2. A mining machine as set forth in claim 1 wherein said central portion has passageways therein and energizable power transmitting means extending through said passageways and connected to said drive means to permit energization of said drive means.

3. A mining machine as set forth in claim 2 wherein said drive means includes an electrical motor portion and said power transmitting means are insulated electrical conductors.

4. A mining machine as set forth in claim 2 including coolant passageways and coolant transmitting and return means extending through said passageways for providing coolant flow to cool said drive means.

5. A mining machine as set forth in claim 1 wherein said drive means within said forward end consists of left and right hand identical drive means in said support portions respectively.

6. A mining machine as set forth in claim 1 wherein said drive means includes an elongated motor and planetary gear means located adjacent the axially outer end of said motor with said motor, said shaft, and said gear means having axes of rotation coincident with said axis.

7. A mining machine as set forth in claim 1 wherein said rotary means comprises a pair of longitudinally spaced sprockets.

8. A mining machine as set forth in claim 1 wherein said cutting means is an endless elongated chain cutter supported at its innermost end by means carried by said boom.

9. A mining machine as set forth in claim 1 wherein said drive means consists of an electric motor and gear means in each of said support portions with each of said gear means being located a greater distance from said central portion than said motors and wherein each of said drive means includes independent ones of said rotatable shaft means having longitudinally spaced free ends engaging said rotary means.

10. A mining machine comprising: a mobile support; a boom carried by said mobile support and having an elongated extent with one end of said elongated extent forming the central portion of an elongated forward end of said boom extending transversely of said elongated extent along an axis; said forward end including elongated support portions extending outwardly from longitudinally spaced portions of said central portion coaxially along said axis; cutting mean supported axially intermediate said longitudinally spaced portions of said central portion for movement through an orbital path to cut clearance for at least said central portion; elongated cutter drum means supported by said support portions, respectively, for coaxial rotation about said axis to cut clearance for the remainder of said forward end; elongated rotary means drivingly connected to said cutting means and extending coaxially along said axis; elongated energizable drive means supported entirely within said forward end coaxially with said axis and having substantially the entire axial extent thereof extending intermediate the axial ends of said rotary means; and said drive means having rotary driving connections adjacent the outer axial end thereof to said rotary means and said drum cutter means for driving said cutting means and said drum cutter means, respectively.

11. A mining machine as set forth in claim 10 wherein substantially the entire axial extent of said elongated rotary means extends axially outwardly of said central portion.

* * * * *

UNITED STATES PATENT OFFICE

CERTIFICATE OF CORRECTION

PATENT NO. : 4,047,763

DATED : September 13, 1977

INVENTOR(S) : James L. Gilliland et al.

It is certified that error appears in the above-identified patent and that said Letters Patent are hereby corrected as shown below:

In Col. 1, line 36, the word "heads" is corrected to read --head--.

In Col. 3, line 22, the word "annular" is corrected to read --annulus--.

In Col. 3, line 39, the word "openings" is corrected to read --opening--.

In Col. 4, line 44, the word "sprockets" is corrected to read --sprocket--.

In Col. 5, line 26, the initial word "an" is deleted.

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*